US005958182A

United States Patent [19]

Hondroulis et al.

[11] Patent Number: 5,958,182

[45] Date of Patent: Sep. 28, 1999

[54] PROCESS FOR CONVERTING TROPICAL PLANT MATERIAL INTO FIBERS

[75] Inventors: Dimitrios George Hondroulis, Metairie, La.; Ian Paul Ratowsky, Harrisburg, Pa.

[73] Assignee: FyBx Corporation, New Orleans, La.

[21] Appl. No.: 08/835,081

[22] Filed: Apr. 4, 1997

[51] Int. Cl.[6] ..... D21B 1/16; D21H 11/12

[52] U.S. Cl. ..... 162/24; 162/91; 162/97; 162/98

[58] Field of Search ..... 162/96, 97, 98, 162/99, 24, 91, 261, 359.1, 270

[56] References Cited

U.S. PATENT DOCUMENTS

| | | | |
|---|---|---|---|
| 151,662 | 6/1874 | Herron . | |
| 264,168 | 9/1882 | Jordan . | |
| 450,119 | 4/1891 | Warrand . | |
| 450,120 | 4/1891 | Warrand . | |
| 456,241 | 7/1891 | Davis . | |
| 497,911 | 5/1893 | Davis . | |
| 1,181,553 | 5/1916 | Taylor et al. . | |
| 1,357,580 | 11/1920 | Moody et al. . | |
| 1,362,723 | 12/1920 | Marr . | |
| 1,367,279 | 2/1921 | Pomorski . | |
| 1,717,798 | 6/1929 | Marr . | |
| 1,831,740 | 11/1931 | Elöd . | |
| 1,882,657 | 10/1932 | Elod | 162/99 |
| 1,981,883 | 11/1934 | Tappan | 92/3 |
| 2,520,483 | 8/1950 | Vanderjagt | 8/117 |
| 3,617,565 | 11/1971 | Fahlvik | 210/40 |
| 3,694,308 | 9/1972 | Botz | 162/96 |
| 3,791,990 | 2/1974 | Fletcher | 252/427 |
| 4,343,680 | 8/1982 | Field et al. | 162/100 |
| 4,497,712 | 2/1985 | Cowling | 210/691 |
| 4,547,263 | 10/1985 | Quame | 162/14 |
| 4,604,313 | 8/1986 | McFarland et al. | 428/172 |
| 4,659,478 | 4/1987 | Stapelfield et al. | 210/690 |
| 4,902,544 | 2/1990 | Kim et al. | 428/36.1 |
| 4,925,343 | 5/1990 | Raible et al. | 405/60 |
| 4,969,774 | 11/1990 | Arseneault et al. | 405/60 |
| 5,009,790 | 4/1991 | Bustamante et al. | 210/689 |
| 5,021,390 | 6/1991 | Hatton | 502/401 |
| 5,114,593 | 5/1992 | Diaz | 210/691 |
| 5,186,831 | 2/1993 | DePetris | 210/242.4 |
| 5,198,074 | 3/1993 | Villavicencio et al. | 162/15 |
| 5,227,072 | 7/1993 | Brinkley | 210/671 |
| 5,229,006 | 7/1993 | Brinkley | 210/671 |
| 5,271,691 | 12/1993 | Willet et al. | 405/60 |
| 5,352,780 | 10/1994 | Webb et al. | 536/56 |
| 5,360,654 | 11/1994 | Anderson et al. | 428/98 |
| 5,403,478 | 4/1995 | Brinkley | 210/242 |
| 5,468,536 | 11/1995 | Whitcomb et al. | 428/98 |
| 5,492,881 | 2/1996 | Diamond | 502/401 |

OTHER PUBLICATIONS

Boyd, C.R., & Ramaswamy, G.N. (1995). Product Development Using a Kenaf Blend Textile. Proceedings of International Kenaf Association, 173–178, Dallas, TX.

Borazjani, A. and Diehl, S. V. 1994. Kenaf Core as an Enhancer of Bioremediation. In "A Summary of Kenaf Production and Development Research (1989–1993)". MAFES Bulletin #1011. Miss State Univ. May 1994 pp. 26–27.

(List continued on next page.)

*Primary Examiner*—Dean T. Nguyen

*Attorney, Agent, or Firm*—Gerald R. Boss, Esq.; Troutman Sanders LLP

[57] ABSTRACT

A process for converting tropical materials into fibers useful in paper-making, textiles, insulation, general fiber filler and the absorption of liquids. The tropical materials utilized in the process include, banana, plantain or cavendish plant stalks, pineapple crowns, coconut, palm or palmetto fronds, or the pinzote of palm. The process includes the steps of: reducing the raw fibrous plant materials to separated fibers by cutting, shredding or grinding; washing the separated fibers in a mild alum solution to extract latex and natural resinous substances; pressing the fibers to remove a high percentage of excess water and residual latex and natural resinous substances with the consumption of a minimum amount of energy; and drying the fibers to less than 10% by weight water content.

3 Claims, 11 Drawing Sheets

OTHER PUBLICATIONS

Lab Safety Supply, Inc., Catalog pp. 586–598.

Metro Industrial Sales Co., Exsorbet Brochure.

Sorbent Control Systems, Inc., Sorbee Brochure.

G. N. Ramaswamy et al., Kenaf/Cotton Blends for Textiles, Family and Consumer Sciences Research Journal, 24:2 pp. 180–190. Dec. 1995.

K. Russell, Mississippi hosts Japanese Paper & Pulp Executives on Kenaf Fact–finding Mission, Mississippi Business Journal, 18:23 Jun. 3, 1996.

Millsaps Sorbent and Environmenta Laboratory, Final Report on Sorbency Evaluation for Kenaf, Aug. 31, 1993.

PROCESS FOR CONVERTING TROPICAL PLANT MATERIAL INTO FIBERS

BACKGROUND OF THE INVENTION

1. Technical Field

This invention relates generally to a process for producing useful fibers from tropical fiber waste products for ultimate use in connection with a variety of applications, such as the absorption of liquids, paper, textiles, insulation and general fiber filler. The invention also relates to an apparatus for producing the useful fibers.

2. Description of the Prior Art

Presently, banana stalks, plantain stalks, Cavendish plant stalks, pineapple crowns, palm, palmetto and coconut fronds, as well as a variety of other fibrous tropical plant materials are thought of as waste agricultural byproducts in the countries in which they are produced. Currently these byproducts are usually disposed of in landfills, where they can attract insects and contribute to landfill capacity problems. Additionally, they may be discarded into rivers, where they oxidize and can cause potential environmental problems. In other instances, the byproducts are left on the ground to act as a natural fertilizer. Clearly, it would be desirable to convert these plant byproducts into useful fibers rather than allowing them to contaminate the environment.

Generally, these plant materials have a water and natural latex content of as much as 80% by weight, including a variety of resinous or gummy substances. In order to produce workable fibers which have characteristics desirable for use in liquid absorbent applications, textiles, papermaking and insulation, it is necessary to extract these fluids and, in particular, wash out or extract the latex and other natural resinous substances.

Several methods of processing these fibers have been previously developed. However, each suffers from its own drawbacks.

For example, U.S. Pat. No. 1,181,553 to Taylor et al. discloses a process for manufacturing paper pulp from waste by-products of banana plantations, including the steps of: crushing and squeezing the banana plant to break down the fiber and to extract water and natural plant juices; brushing or carding to further separate the fibers; drying and cutting the fibers to the desired length; boiling the fibers in alkali to further clean them and remove resinous or gummy material; and optionally bleaching the fibers if a white paper pulp is desired. However, a shortcoming of this process is that Taylor removes approximately 90% of the natural liquids and resinous material, in large part, by boiling the fibers in an alkaline solution which is likely to damage the fibers and is unnecessarily energy intensive.

Likewise, U.S. Pat. No. 4,547,263 to Quame discloses a process and apparatus for recovering useful products from green plantain stem, including paper pulp. The process of Quame includes the steps of cutting or shredding the raw plant materials; pressing the stems to extract excess liquids; beating the de-liquefied stems; squeezing the resulting slurry; removing pith cells from the fibers; steam cooking the fibers; and bleaching the fibers. The invention of Quame is complex and requires the use of a variety of potentially environmentally damaging reagents including various acids, bases and bleaches. Furthermore, several of the steps described by Quame involve use of steam, which may damage the fibers and is an unnecessarily energy intensive process.

U.S. Pat. No. 1,981,883 to Tappan describes a process for converting banana stalks into paper fibers including cleaning, splitting and de-coring the stalks, crushing the stalks, separating the fibers, drying the fibers and packaging the fibers. Tappan specifies the juices from the banana stalks extracted by the crushing step may be collected and may themselves constitute a useful by-product. Importantly, the process of Tappan does not include any step wherein the fibers are washed or the latex and other resinous substances are extracted, and hence this process is likely to produce dirty fibers with less than desirable fiber characteristics.

A novel approach to this problem is described by Moody in U.S. Pat. No. 1,357,850, which describes a process for obtaining useful fibers from banana stalks and other similar tropical vegetation by immersion of the raw plant materials in electrolyzed brine. The electrolyzed brine solution disintegrates the bulk material, separating the fibers while simultaneously bleaching them. While this process does not involve the use of any environmentally damaging reagents, it is very energy intensive and does not produce a very high quality material.

A number of other processes have been described which rely on boiling in various chemical solutions to extract the resinous material or digest the solid materials associated with the fibers. Processes have been described using aqueous solutions of zinc sulfate and oil (see U.S. Pat. No. 1,362,723 to Marr), sodium nitrate (see U.S. Pat. No. 1,717,798 to Marr) and various alkali solutions. All of these processes rely on the use of potentially environmentally damaging reagents which may introduce associated disposal problems.

As should be readily understood, none of these processes have been optimized to provide a high fiber quality while minimizing the impact of the processing steps on the surrounding environment, both in terms of chemical waste and energy usage.

SUMMARY OF THE INVENTION

The present invention recognizes and addresses, the abovediscussed shortcomings and disadvantages, as well as others, of compositions and processes for extracting useful fibers from agricultural waste products. In accordance with the teachings of the present invention, a novel process for converting agricultural waste products, such as tropical vegetation, into useful fibers is disclosed.

Generally, the present invention consists of a process for recovering useful fiber from agricultural waste products produced in the cultivation of banana, plantain, pineapple, coconut, palm and other tropical fruit bearing crops. These byproducts include, but are not limited to, banana, plantain or Cavendish plant stalks, pineapple crowns, coconut palm or palmetto fronds or the pinzote (fruit bearing body) of palm. The fibers may be used for a variety of purposes, including the absorption of liquids, paper making, textiles, insulation and general fiber filler.

More specifically, this process includes the following steps: the raw fibrous plant materials are cut, shredded or ground to separate the fibers; the fibers are washed to extract latex and natural resinous substances; the fibers are pressed to remove a high percentage of excess water and natural liquids, such as latex; the fibers are then dried. The fibers produced from the above processes may be further refined by additional fiber reduction and separation steps. Furthermore, this procedure may be fully or partially automated.

In general, the plant materials utilized in the present invention have a high content of water and natural latex, of which a substantial portion must be removed to produce fibers useful in the absorption of liquids, paper making, textiles, etc. The washing and pressing steps are therefore very important, as these are the primary steps wherein natural fluids are removed from the fibers. Furthermore, the washing step includes the addition of a small amount of alum to the water, which breaks down the natural latex of the fiber producing a cleaner fiber which is less likely to mold or ferment. The pressing step following the wash step is also important for the recovery of fibers from sources containing a high liquid content with a minimum of energy consumption, as liquid removal in the subsequent drying steps is much more energy intensive.

In a preferred embodiment, the processed tropical fibers are processed to have a final water and natural liquid content of less than 10% by weight. Approximately 50% of the naturally occurring latex is also removed by this processing. Once dried to this point the processed fibers become somewhat hydrophobic, without requiring the addition of additives. Accordingly, this hydrophobicity makes the resulting fibers an excellent material for the absorption of oil and other hydrophobic liquids, paper making, textiles, etc.

It should be readily appreciated that this process provides a use for tropical agricultural byproducts which would otherwise be disposed of as waste material in potentially environmentally harmful ways. Additionally, this process provides an alternative source of paper-making pulp, thereby reducing the need for logging and deforestation. Furthermore, by minimizing the use of energy and potentially hazardous materials, this process reduces the potential environmental impact below that found in prior methods of fiber recovery from tropical plants. The tropical fiber material is also relatively inexpensive since it may be produced from plentiful agricultural byproducts which are currently largely unused.

The aforementioned and other aspects of the present invention are described in the detailed description and attached illustrations which follow.

DETAILED DESCRIPTION OF PREFERRED EMBODIMENT

Figure 1:
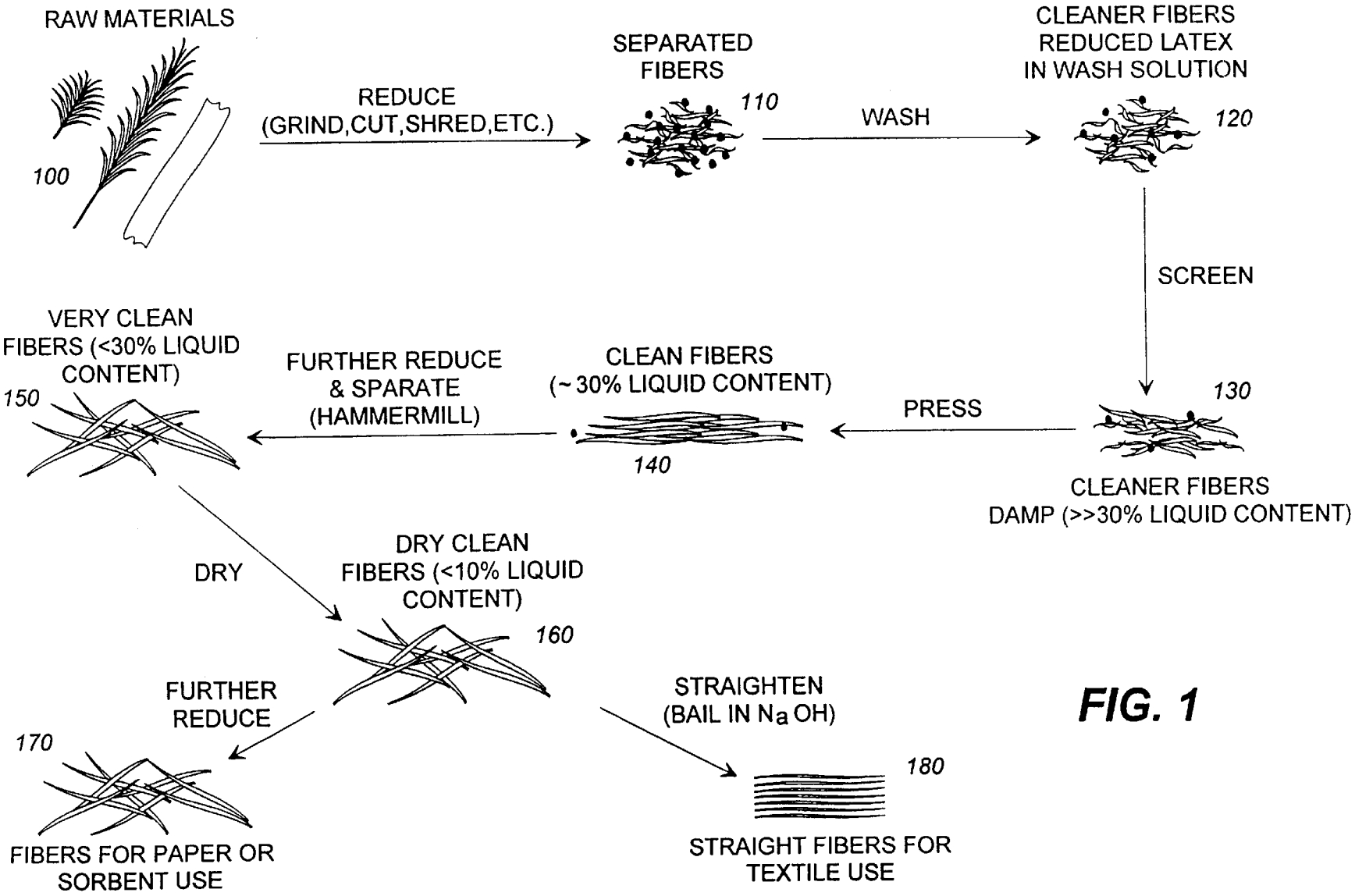
FIG. 1 is a diagram illustrating the fiber composition through the fiber recovery process.
Figure 2:
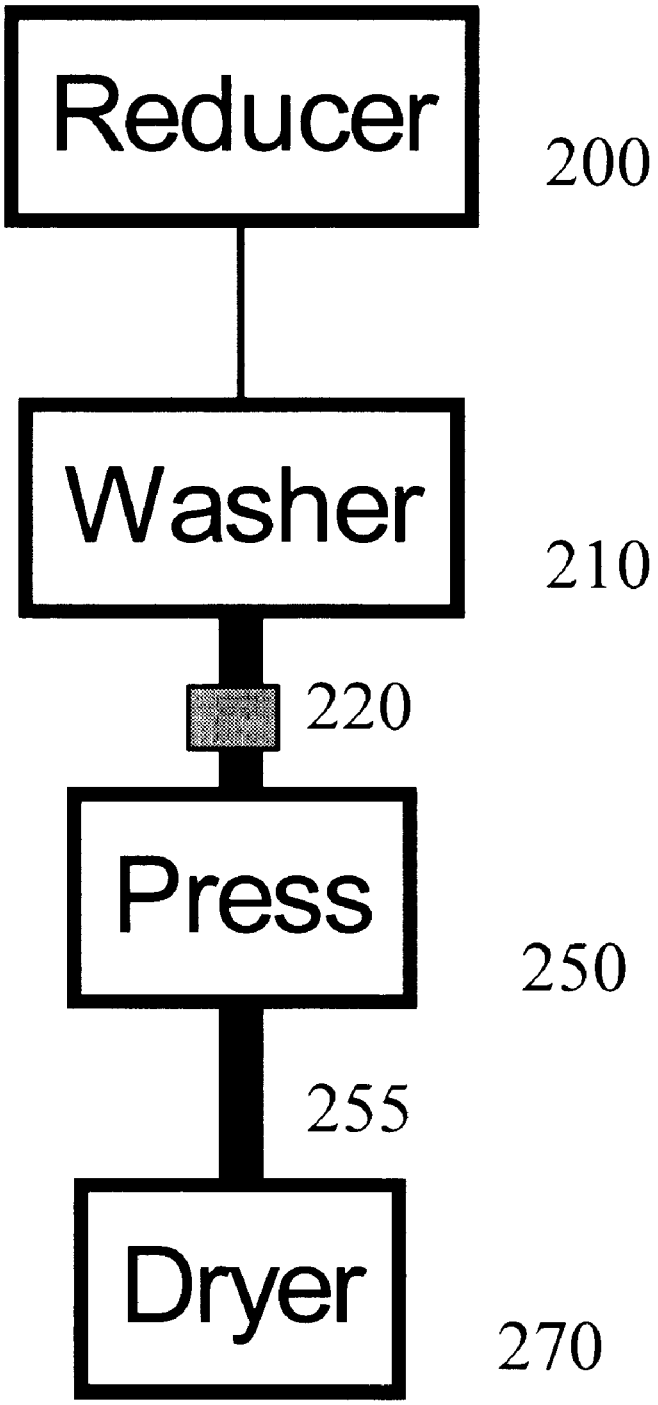
FIG. 2 is a diagram showing the components comprising the apparatus for conversion of the tropical plant materials to useful fibers.
Figure 7:
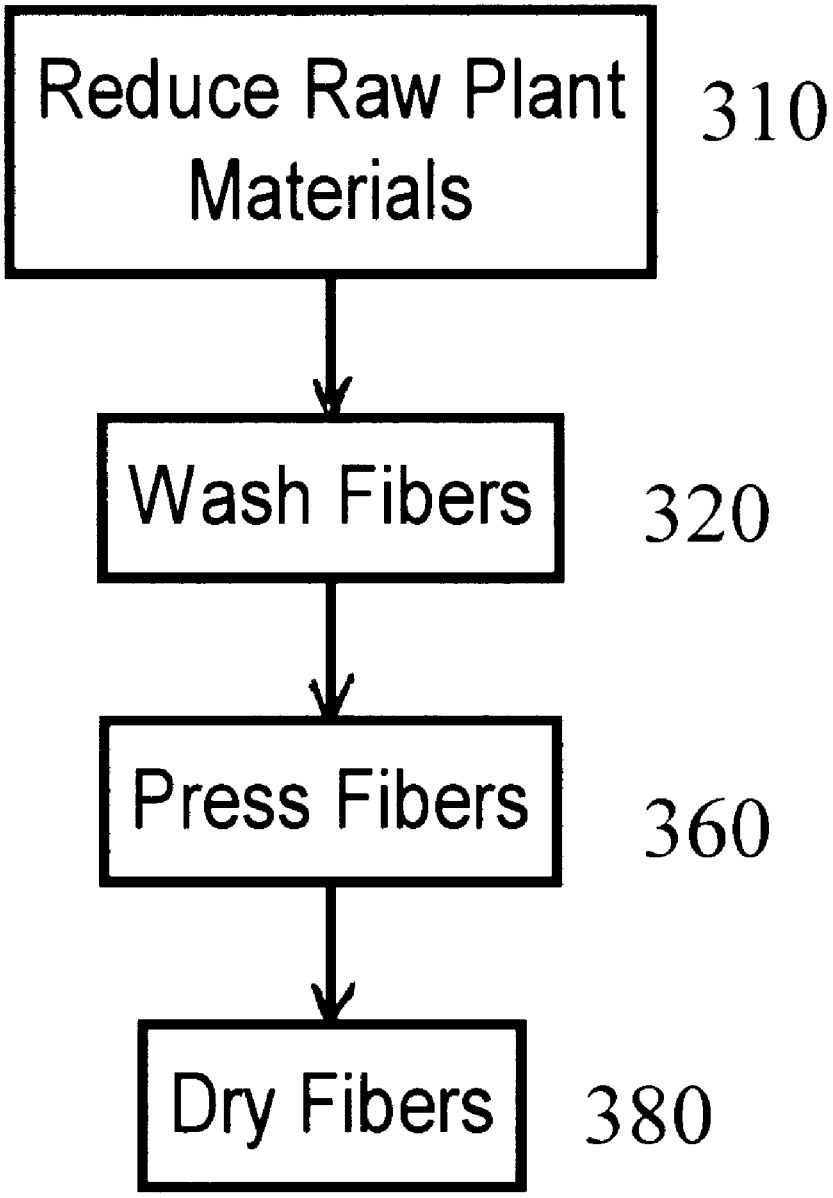
FIG. 7 is a flow diagram showing the steps used for conversion of the tropical plant materials to useful fibers.

Referring now to the figures in which like reference numerals indicate like or corresponding features, FIG. 1 is a diagram showing the composition of the fibers at each major processing step described below. FIG. 2 is a representation of the machine components for the processing of fibers in the present invention in the preferred embodiment and FIG. 7 is a flow diagram illustrating the processing steps in the preferred embodiment.

In the preferred embodiment, the fibers are produced from banana, plantain or Cavendish plant stalks, pineapple crowns or other similar high liquid content raw plant materials 100. These materials are byproducts of the cultivation of these crops, and are produced in large quantities on a yearly basis since these plants generally produce fruit only one time before harvesting and disposal of plant materials such as stems and crowns. Instead of simply disposing of these materials after harvest, in the preferred embodiment the stalks or crowns are gathered and transported to a central processing site for recovery of useful fibers.

Once at the processing site, the raw plant materials 100 are cut, ground, shredded or otherwise reduced 310 into a mass of separated fibers 110; the fibers 110 are washed 320 in a solution of 1% alum; the washed fibers 120 are pressed 360 to extract liquids and natural juices; the pressed fibers 130 may be further reduced 370 by beating or agitating; and the fibers 140 are dried 380 to the final fiber product 160. This procedure may be automated.

In the preferred embodiment the raw plant materials 100 are first separated 310 in a reducer 200, which may consist of a bladed roller that draws the stalks or crowns into a series of rotating ¼" steel knives or blades. These blades cut the stalks into fibers ranging from ¼" to 1" in length 110 and serve to separate the fibers. The separated fibers are then propelled through the grinder neck into the awaiting washer 210.

The separated fibers 110 are washed 320 in a solution of 1% alum in water for a period ranging from 15 min. to 45 min. During this wash step 320 the separated fibers 110 are constantly subjected to the action of bladed paddles which act to agitate the fibers and further separate them. In the preferred embodiment, the washer 210 is agitated by the action of four rows of eight steel blades, each blade having a ½ inch diameter.

This washing step 320 is of critical importance in the fiber preparation process in several respects. Washing the raw plant material in a mild aqueous solution of alum (aluminum sulfate) reduces oxidation of the fibers and results in the extraction of a substantial portion of the latex and other resinous natural juices found in the stalk. This leads to production of a cleaner fiber which is less likely to mold or ferment upon storage. Furthermore, cleanliness of the fiber is a major customs requirement for international shipping of the fibers.

Removal of a portion of the latex and other plant natural juices is also necessary in order to obtain useable fibers which are not initially aggregated and difficult to work with upon drying. It is, however, necessary that a portion or these materials be retained both to impart ink and water resistance to paper made from the fibers and to contribute to the hydrophobicity of the fiber product for fiber use in absorbent processes. It is likewise important for use in liquid absorbent applications and paper-making that the wash step no be carried out by boiling at high temperature, since this can lead to undesirable softening and degradation of the fibers.

Figure 3:
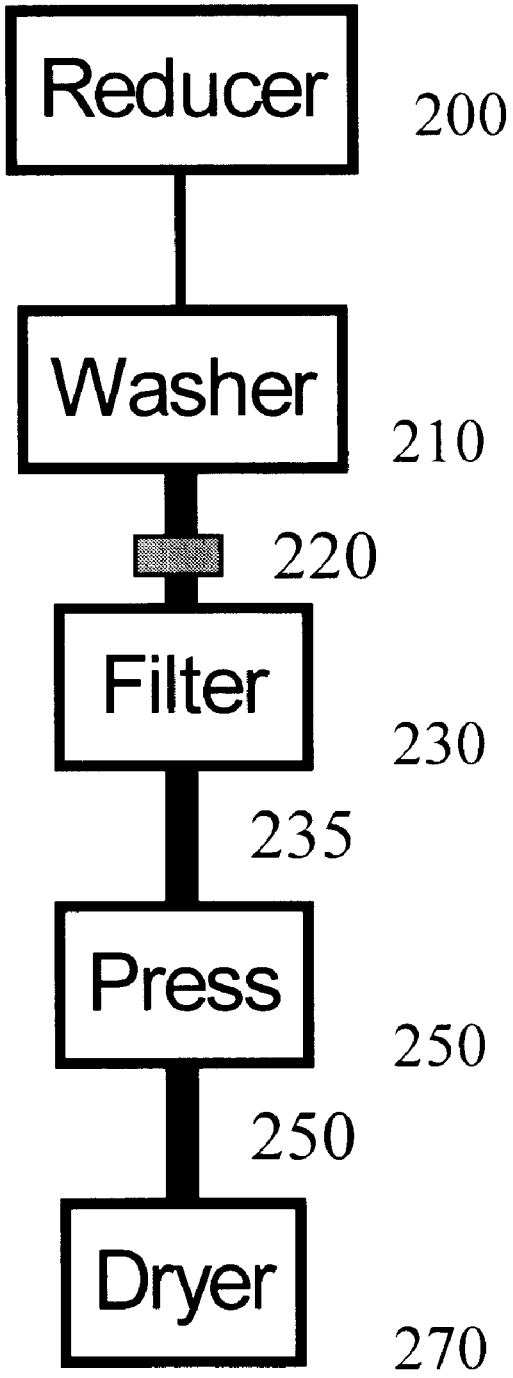
FIG. 3 is a diagram showing the components comprising the apparatus for conversion of the tropical plant materials to useful fibers in an embodiment utilizing a filter to separate wash water from the fibers prior to pressing.
Figure 8:
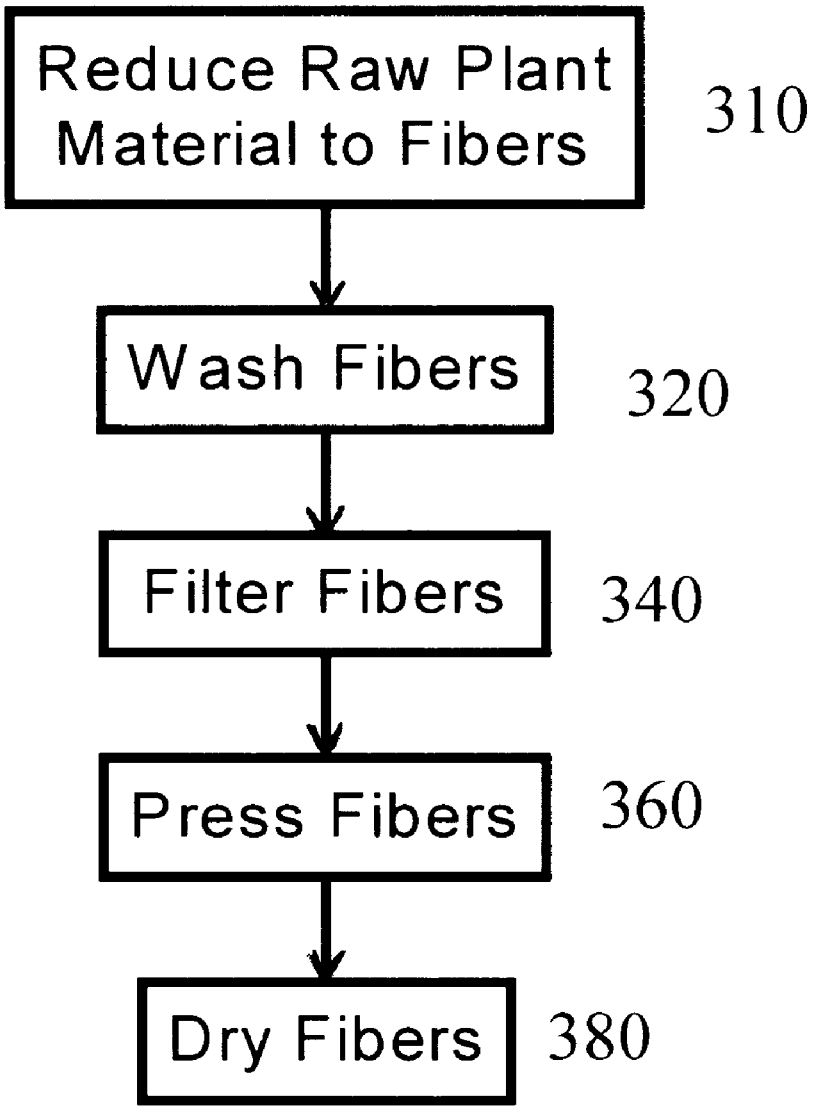
FIG. 8 is a diagram showing the steps conversion of the tropical plant materials to useful fibers in an embodiment utilizing a filter to separate wash water from the fibers prior to pressing.

After adequate washing 320, the washed fibers 120 are then pumped out of the washer 210 by a pump 220 which may consist of a common sewer pump. This pump also serves to further separate the washed fibers 120. Referring to FIG. 3 and FIG. 8, the washed fibers 120 may then be deposited onto a filter 230, which may consist of a steel mesh screen, and strained to separate the washing solution from the washed fibers 120. Excess washing solution can then be recycled back into the washing system.

In an alternate embodiment, the washer 210 may consist of a pressure washer. The fibers may be washed by using the pressure washer to continuously or intermittently apply a solution of alum and water to the fibers at high velocity, serving to remove dirt and debris from the fibers. The pressure washer allows the fibers to be washed while on a conveyor, allowing a continuous flow of fibers to be washed rather than separate batches of fibers.

After straining, the strained fibers 130 are transported by hand or a conveyor 235 to a press 250 for pressing 360 to remove a significant portion of the remaining water, latex and other natural juices. The press 250 exerts a high tonnage and may be a hydraulic press, a screw press or a belt press. The resulting compressed fiber mass 140 has a water and natural liquid content or approximately 25–30% by weight. It is important to note that this relatively low liquid content is easily achieved by pressing 360 after the initial reducing 310 and washing 320 steps and prior to the further reduction 370 of the fibers and drying 380 of the fibers. This results in a reduction in the time and energy required to subsequently dry the fibers and a substantial improvement of the workability of the fibers during the following steps.

Figure 4:
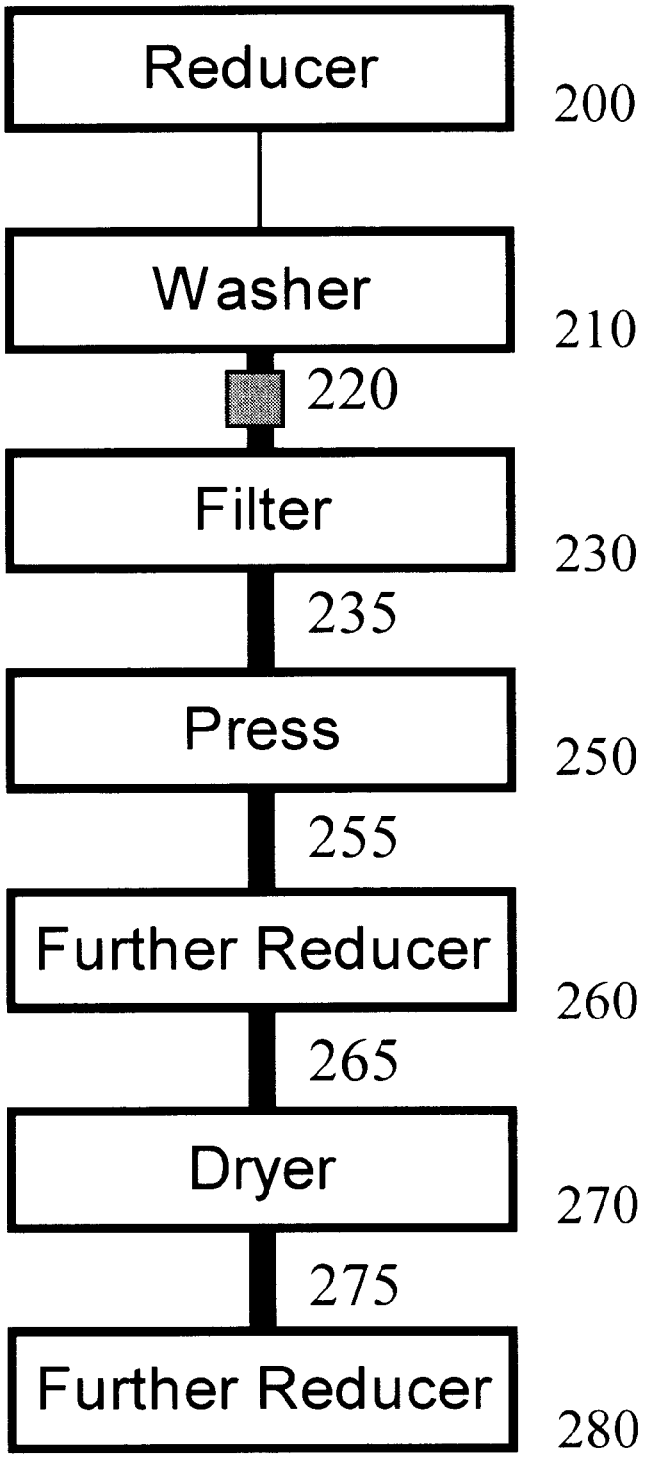
FIG. 4 is a diagram showing the components comprising the apparatus for conversion of the tropical plant materials to useful fibers utilizing the optional components of a. filter to separate was water from the fibers prior to pressing and two further reducers to further refine the fibers.
Figure 9:
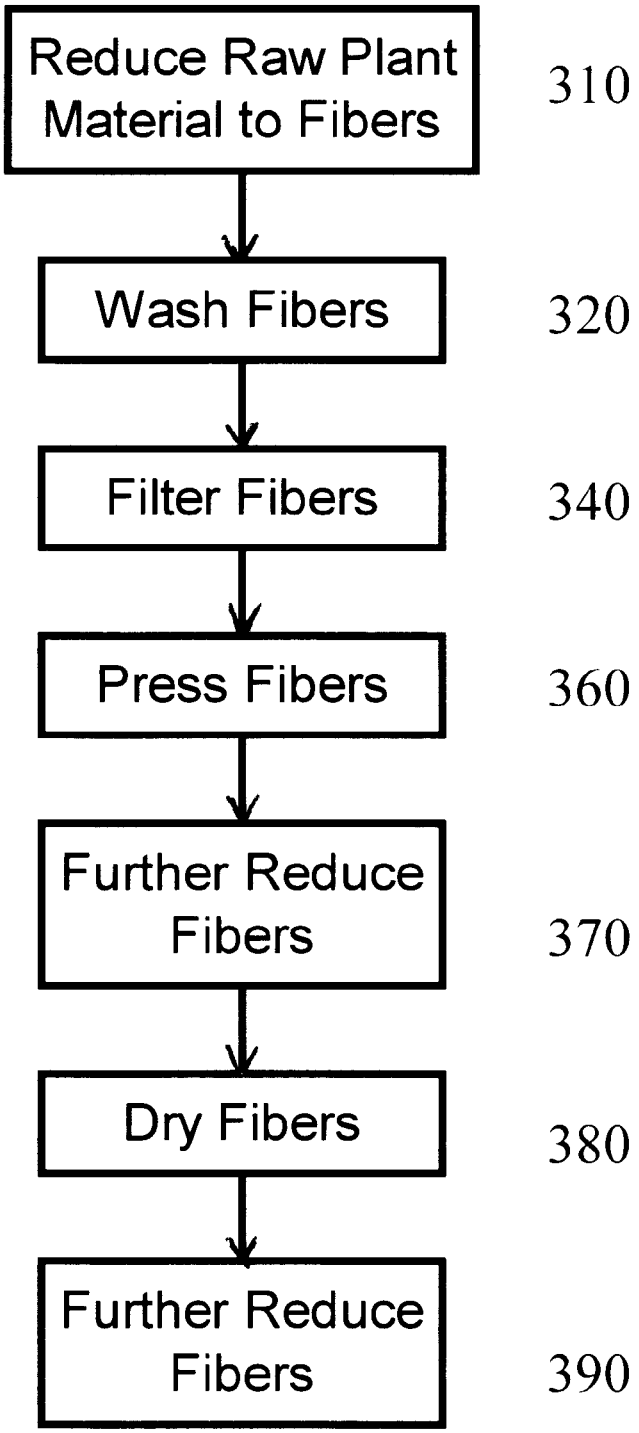
FIG. 9 is a diagram showing the steps used for conversion of the tropical plant materials to useful fibers utilizing the optional components of a filter to separate was water from the fibers prior to pressing and two further reducers to further refine the fibers.

Referring to FIG. 4 and FIG. 9, after pressing 360 the compressed fibers 140 are transported by a conveyor 255 and may optionally be further reduced 370 in a further reducer 260, which may consist of a hammer mill with an attached blower. This further reducer 260 both separates the fibers and allows for removal of any residual dirt or skin from the stalk which may still be entrained in the fibers.

The milled fibers 150 are then transported by conveyor 265 into an industrial strength dryer 270 which circulates hot air from an incinerator through the milled fibers 150 to dry 380 them to a liquid content of approximately 1–15%. The dried fibers 160 may then be transported by conveyor 275 to a second optional further reducer 280, which again may be a hammer mill. This second further reducer 280 pulverizes the fibers reducing 390 them to refined fibers 170 of ⅛" to ¼" in length. The refined fibers 170 may then be baled by a conventional hay baler or bagged for transport and storage. Depending upon the application for which the fibers are intended, either or both of the further reducing steps may be omitted to produce a lower grade of fiber or longer final fiber length.

Figure 5:
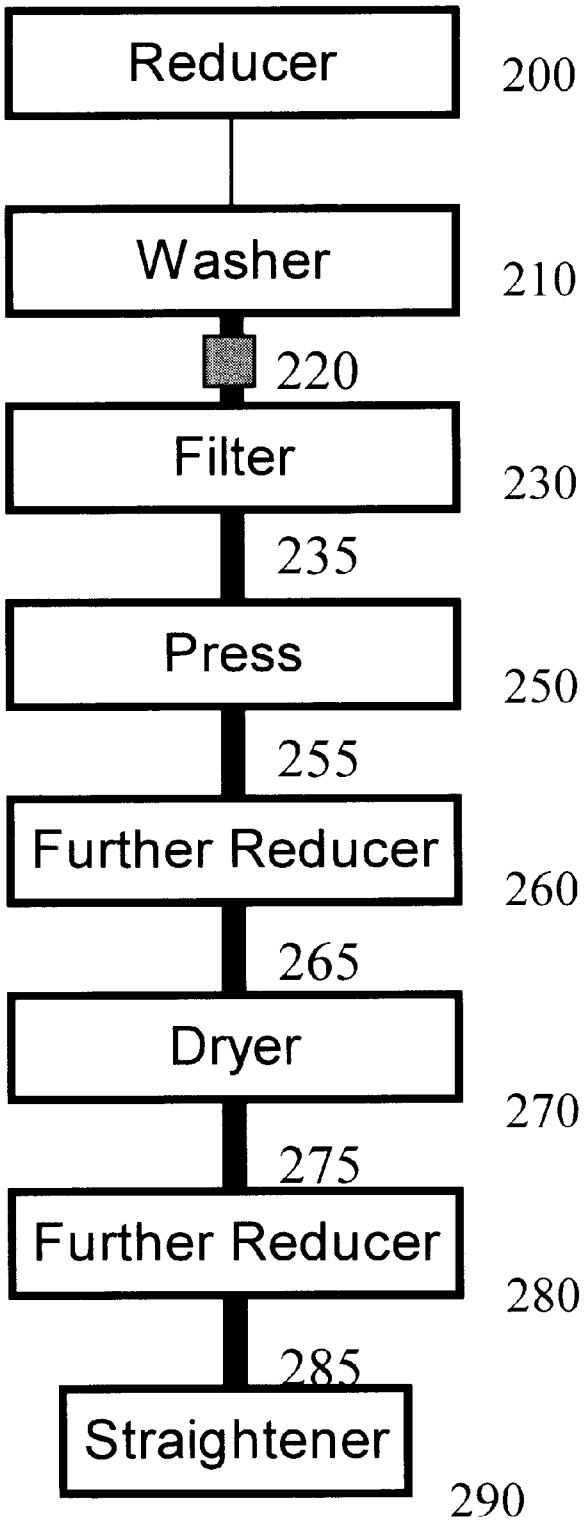
FIG. 5 is a diagram showing the components comprising the apparatus for conversion of the tropical plant materials to useful fibers including an optional press to squeeze out natural liquids prior to the washing of the fibers in the washer.
Figure 10:
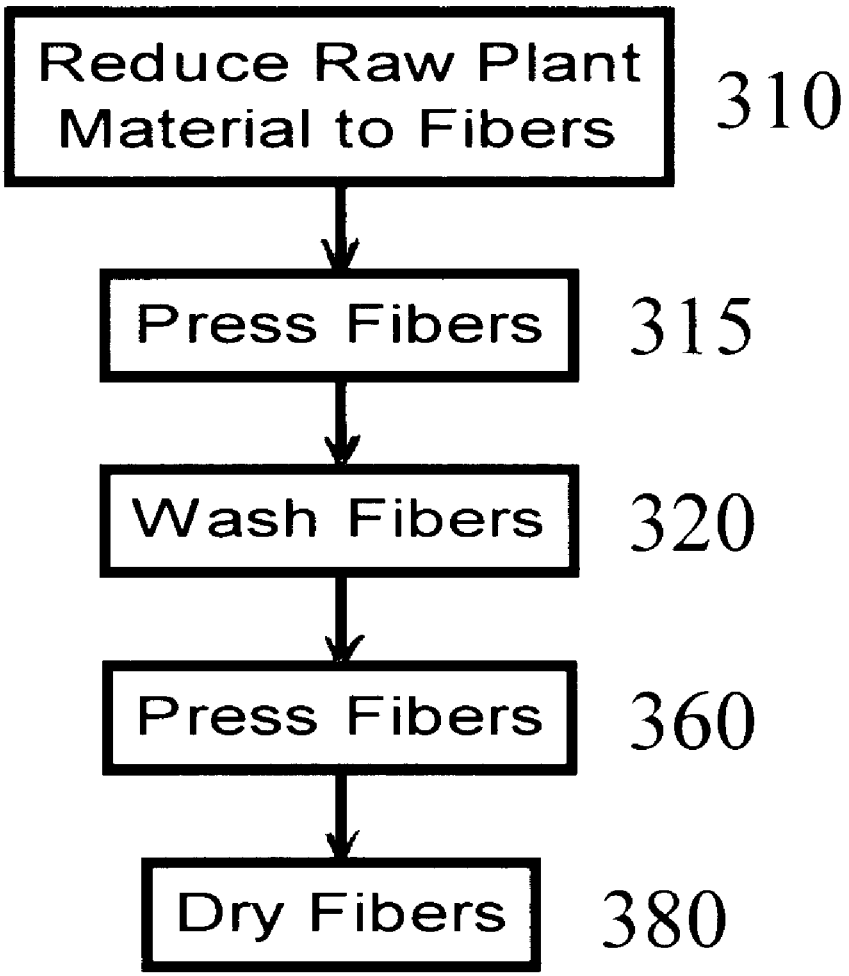
FIG. 10 is a diagram showing the steps used for conversion of the tropical plant materials to useful fibers including an optional press to squeeze out natural liquids prior to the washing of the fibers in the washer.

Referring to FIG. 5 and FIG. 10, if an even lower content of latex and other natural liquids is desired, the separated fibers 110 may be subjected to an initial pressing step 315 in a press 295 prior to the washing step 320 described above. This initial pressing step 315 results in removal of a substantial percentage of the naturally present latex, in addition to that removed by the washing and second pressing steps. Furthermore, the latex and other natural juices extracted in the initial pressing step may be collected as a useful product in themselves.

Figure 6:
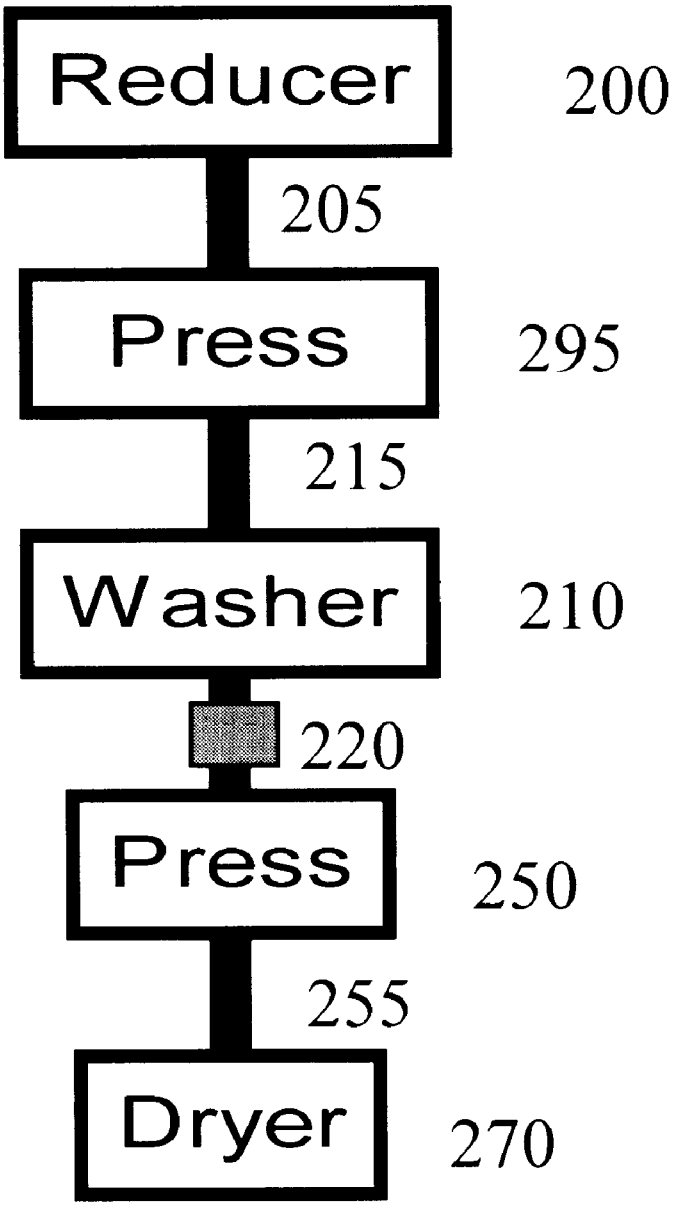
FIG. 6 is a diagram showing the components comprising the apparatus for conversion of the tropical plant materials to useful fibers utilizing the optional components of a filter to separate was water from the fibers prior to pressing, two further reducers to further refine the fibers and a straightener wherein the fibers are boiled to straighten them for use in textiles.
Figure 11:
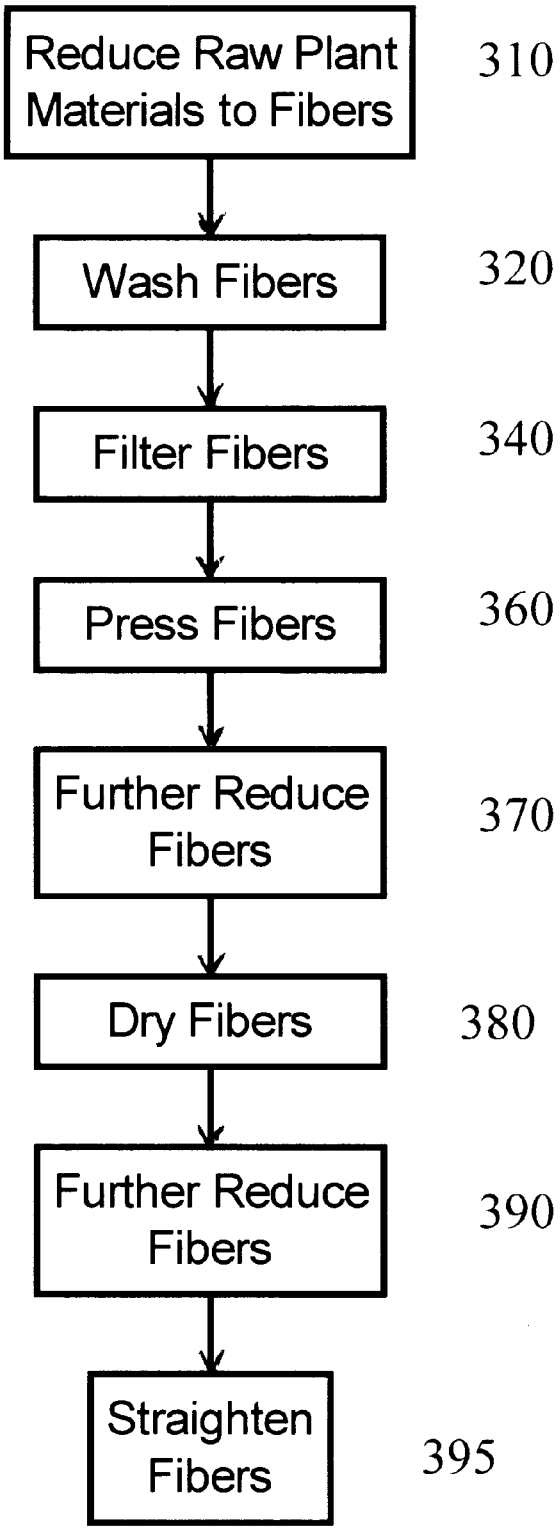
FIG. 11 is a diagram showing the steps used for conversion of the tropical plant materials to useful fibers utilizing the optional components of a filter to separate was water from the fibers prior to pressing, two further reducers to Further refine the fibers and a straightener wherein the fibers are boiled to straighten them for use in textiles.

The refined fibers 170 produced in the above process, while clean and strong, are more fluffy and curly than is desirable for use in textile applications. Therefore, as shown in FIG. 6 and FIG. 11, in an alternate embodiment the refined fibers 170 are transported by conveyor 285 to straightener 290. The refined fibers 170 are then boiled for a short time in a straightener 290 to straighten 395 them. This straightener may be boiler tank containing a mild solution of sodium hydroxide, potassium hydroxide or hydrogen peroxide. The straightened fibers 180 may then be subjected to standard weaving methods to process them into fabric.

One skilled in the art will recognize that many variations of this embodiment are practical including conversion of this system to a continuous flow system wherein raw plant material is constantly being fed into the grinder, dropped into the washing tank, pumped to the straining screen, moved by conveyor into a screw type press or other means to constantly squeeze out moisture, and moved by conveyor through the further refining and drying steps previously described.

What has been described above are merely preferred embodiments of the present invention. It is, of course, not possible to describe every conceivable combination of methodologies for purposes of describing the present invention. However, one of ordinary skill in the art will recognize that many further combinations, permutations and modifications of the present invention are possible. Therefore, all such possible combinations, permutations and modifications are to be included within the scope of the claimed invention, as defined by the claims below.

We claim:

1. A process for converting a tropical plant material into naturally hydrophobic fibers, said process comprising the steps of:

providing a naturally hydrophobic fibrous tropical plant material having an initial latex content, said fibrous tropical plant material selected from the group consisting of: banana stalks, plantain stalks, Cavendish plant stalks and pineapple crowns;

reducing said fibrous tropical plant material to a form a plurality of separated fibers having a initial latex content;

washing said plurality of separated fibers in an aqueous solution to extract a first portion of latex and other hydrophobic natural juices therefrom;

pressing said plurality of washed separated fibers to remove a second portion of latex and other hydrophobic natural juices therefrom, wherein said pressed fibers retain sufficient latex and other hydrophobic natural juices to remain hydrophobic;

drying said plurality of pressed separated fibers; and wherein said dried seperated fibers have a latex content less than 50% of said initial latex content of said fibers prior to washing.

2. The process of claim 1, wherein said pressing step removes water, latex, and other hydrophobic natural juices to less than 30% by weight of said plurality of separated fibers.

3. The process of claim 1, wherein said processed fibers have a water, latex, and other hydrophobic natural juices content of less than 10% by weight following said drying step.

* * * * *

UNITED STATES PATENT AND TRADEMARK OFFICE

CERTIFICATE OF CORRECTION

PATENT NO. : 5,958,182

DATED : September 28, 1999

INVENTOR(S) : Hondroulis et al.

It is certified that error appears in the above-identified patent and that said Letters Patent is hereby corrected as shown below:

On the title page item [75], delete "Ian Paul Ratowsky, Harrisburg, Pa"

Signed and Sealed this

Seventh Day of November, 2000

*Attest:*

Q. TODD DICKINSON

*Attesting Officer*

*Director of Patents and Trademarks*